US005989411A

United States Patent [19]

Gupta

[11] Patent Number: 5,989,411

[45] Date of Patent: Nov. 23, 1999

[54] STAGED UPFLOW HYDROPROCESSING WITH NONCATALYTIC IMPURITY REMOVAL FROM THE FIRST STAGE VAPOR EFFLUENT

[75] Inventor: Ramesh Gupta, Berkeley Heights, N.J.

[73] Assignee: Exxon Research and Engineering Company, Florham Park, N.J.

[21] Appl. No.: 09/177,735

[22] Filed: Oct. 23, 1998

[51] Int. Cl.[6] ..... C10G 25/00; C10G 17/00

[52] U.S. Cl. ..... 208/212; 208/210; 208/211; 208/213; 208/254 H; 203/DIG. 6

[58] Field of Search ..... 208/213, 254 H, 208/210, 211; 203/DIG. 6

[56] References Cited

U.S. PATENT DOCUMENTS

| | | | |
|---|---|---|---|
| 3,234,121 | 2/1966 | MacLaren | 208/264 |
| 5,522,983 | 6/1996 | Cash et al. | 208/59 |
| 5,705,052 | 1/1998 | Gupta | 208/57 |
| 5,720,872 | 2/1998 | Gupta | 208/57 |

*Primary Examiner*—Walter D. Griffin
*Assistant Examiner*—Tam M. Nguyen
*Attorney, Agent, or Firm*—Henry E. Naylor

[57] ABSTRACT

A hydroprocessing process for removing impurities from a feed comprising a hydrocarbonaceous liquid comprises at least two cocurrent, upflow hydroprocessing reaction stages and a non-catalytic, vapor-liquid contacting stage. The reaction and contacting stages may all be in the same reactor vessel. The feed and a hydrogen treat gas are passed up into a catalyst bed which comprises the first reaction stage, which produces a partially hydroprocessed liquid and vapor effluent. This first stage vapor is passed up into the contacting stage in which it contacts a hydrocarbonaceous liquid which reduces the vapor impurity content. The impurity-enriched contacting liquid passes down and mixes with the first stage liquid effluent. The combined effluents and hydrogen are passed up into the second reaction stage to form a processed product liquid and hydrogen-containing vapor effluent. This second reaction stage vapor effluent is passed up into the first stage to provide at least a portion of the hydrogen for the first stage reaction. Additional product liquid may be recovered by cooling the contacting and condensing the purified contacting stage vapor effluent.

26 Claims, 2 Drawing Sheets

STAGED UPFLOW HYDROPROCESSING WITH NONCATALYTIC IMPURITY REMOVAL FROM THE FIRST STAGE VAPOR EFFLUENT

FIELD OF THE INVENTION

The invention relates to staged upflow hydroprocessing of hydrocarbonaceous feeds with noncatalytic impurity removal from the first stage vapor effluent. More particularly the invention relates to a process for catalytically hydroprocessing a hydrocarbonaceous feed in at least two, consecutive cocurrent upflow reaction stages, each of which produces a liquid and a vapor effluent, with non-catalytic removal of impurities from the first reaction stage vapor effluent, in a vapor-liquid contacting stage. The second reaction stage vapor effluent is passed up into the first reaction stage. The first reaction stage vapor effluent is passed into the contacting stage, where feed impurities, such as heteroatom (e.g., sulfur) compounds, are removed by contacting it with a hydrocarbonaceous liquid. The contacting liquid is then hydroprocessed in the second reaction stage, along with the first reaction stage liquid effluent, and the impurity-reduced vapor cooled to condense and recover additional product liquid. The reaction stages and the contacting stage may all be in the same vessel.

BACKGROUND OF THE INVENTION

As supplies of lighter and cleaner feeds dwindle, the petroleum industry will need to rely more heavily on relatively high boiling feeds derived from such materials as coal, tar sands, shale oil, and heavy crudes, all of which typically contain significantly more undesirable components, especially from an environmental point of view. These components include halides, metals, unsaturates and heteroatoms such as sulfur, nitrogen, and oxygen. Furthermore, due to environmental concerns, specifications for fuels, lubricants, and chemical products, with respect to such undesirable components, are continually becoming tighter. Consequently, such feeds and product streams require more upgrading in order to reduce the content of such undesirable components and this increases the cost of the finished products.

In a hydroprocessing process, at least a portion of the heteroatom compounds are removed, the molecular structure of the feed is changed, or both occur by reacting the feed with hydrogen in the presence of a suitable hydroprocessing catalyst. Hydroprocessing includes hydrogenation, hydrocracking, hydrotreating, hydroisomerization and hydrodewaxing, and therefore plays an important role in upgrading petroleum streams to meet more stringent quality requirements. For example, there is an increasing demand for improved heteroatom removal, aromatic saturation and boiling point reduction. In order to achieve these goals more economically, various process configurations have been developed using primarily downflow or trickle bed reactors, including the use of multiple hydroprocessing stages as is disclosed, for example, in U.S. Pat. Nos. 5,522,983; 5,705,052 and 5,720,872. Downflow trickle bed reactors must be designed with a high liquid mass velocity (liquid flow per cross-sectional area) to achieve good contacting of the catalyst with the liquid. This requires the cross-sectional area of the reactor to be small and therefore limited as to the amount of catalyst that it can hold, without the reactor being prohibitively high (e.g., $\geqq$~100 ft.).

SUMMARY OF THE INVENTION

The invention relates to hydroprocessing a hydrocarbonaceous feed in at least two, consecutive cocurrent upflow catalytic reaction stages and a vapor-liquid contacting stage for vapor impurity removal. The hydrocarbonaceous feed is fed into the first reaction stage. The first stage liquid effluent comprises the liquid feed for the second stage and the second stage liquid effluent comprises the hydroprocessed product liquid. Each reaction stage produces a liquid and a vapor effluent, with the second stage vapor effluent passed up into the first stage. The first stage vapor effluent is contacted with a hydrocarbonaceous contacting liquid in the contacting stage, under conditions effective to transfer feed impurities from the vapor to the liquid. The contacting is achieved in a countercurrent or crosscurrent flow contacting stage or zone comprising vapor-liquid contacting media, in which the vapor flows up and the liquid down. In a preferred embodiment, the contacting stage includes internal refluxing for maximum removal of impurities from the vapor. The purified vapor is cooled to condense and recover additional hydroprocessed liquid, which may or may not be combined with the second stage liquid effluent as additional product liquid, and the contacting liquid, which now contains the transferred impurities, is fed into the second reaction stage for purification. In a preferred embodiment, the contacting liquid comprises either or both first and second stage liquid effluent, as is explained in detail below. It is also preferred that the vapor-liquid contacting stage be in the same reactor vessel as the upflow catalytic hydroprocessing stages. The hydroprocessing and contacting remove feed impurities, such as heteroatom (e.g., sulfur) compounds or other undesirable components, initially present in the feed to be hydroprocessed. The second stage effluent comprises hydroprocessed vapor and liquid which have an impurity level lower than that of the feed and corresponding first stage effluents. The first stage vapor effluent contains feed components which include feed impurities. It is these feed impurities which are removed from the first stage vapor effluent, by the vapor-liquid contacting. Thus, by impurities is meant those impurities originally present in the feed, a portion of which are carried into the first reaction stage vapor and liquid effluents, and which are removed by the first and second stage hydroprocessing, and by the vapor-liquid contacting.

The contacting stage vapor effluent has a feed impurity level lower than that of the feed and first stage effluents. In contrast to a trickle bed reactor in which the liquid flows down through the bed in rivulets, in an upflow bed reactor, the liquid and gas both flow cocurrently up through the catalyst bed, which operates as a flooded (i.e., filled with liquid) bed, as opposed to a trickle bed. A flooded bed means that substantially all of the catalyst particles are in contact with the liquid reactant. This permits as much as 20–30 wt. % reduction in the amount of catalyst needed, compared to either a trickle bed or a countercurrent reactor. This 20–30 wt. % catalyst reduction is possible, because in a trickle bed, the liquid flows down through the bed as rivulets. This means that not all of the catalyst particles in the bed are contacted by the liquid and therefore do not participate in the hydroprocessing reactions.

In the embodiment in which both the upflow reaction stages and the vapor-liquid contacting stage are all in the same reactor, the reactor comprises a single reaction vessel. Thus, in this embodiment, the reactor comprises a single vessel containing within (i) the second upflow hydroprocessing reaction stage comprising a fixed bed of catalyst, with vapor-liquid separating means disposed above it (ii) the first hydroprocessing reaction stage comprising a fixed bed of catalyst disposed above the separation means and (iii) a vapor-liquid contacting stage disposed above the first stage. The second stage is disposed near to the bottom of the vessel, with the contacting stage near the top and the first stage located between the second and contacting stages. The reactor also includes means for feeding hydrogen or a hydrogen-containing treat gas below the second reaction stage, means for withdrawing liquid from above the first and second stage catalyst beds, means for withdrawing vapor and introducing a contacting liquid above the contacting stage, and a pump for feeding the liquid withdrawn from above the first stage bed and feeding it as feed below the second stage bed.

The liquid and vapor effluents from each reaction stage are in equilibrium with each other, with respect to the impurity level in each phase, with the impurity level in the second stage effluents much lower than that in the first stage effluents. The hydrocarbonaceous contacting liquid, which contacts the first stage vapor effluent, preferably has an impurity level no greater, and more preferably less, than that present in the first stage liquid effluent. If the impurity level of the contacting liquid is the same as, or greater than, that in the first stage liquid effluent, then the liquid is cooled prior to contact with the first stage vapor, in order to transfer impurities from the vapor into the liquid. It is particularly preferred that the impurity level in the contacting liquid is less than that in the first stage liquid effluent and also that the temperature of the contacting liquid is below that of the first stage vapor effluent, prior to the contacting. This assures more efficient and greater impurity transfer, from the vapor to the liquid. While the contacting liquid may be any suitable hydrocarbonaceous liquid that is compatible with the feed, process and product, because it combines with the first stage liquid effluent and is therefore part of the second stage feed, it is preferred that at least a portion be liquid produced by the process. This includes either or both first and second stage liquid effluent and also hydrocarbonaceous liquid condensed from the first stage vapor effluent. Most preferably all or a portion comprises the second stage liquid effluent. This is explained in detail below. In the reaction stages, the hydrocarbonaceous feed is reacted with hydrogen in the presence of a suitable hydroprocessing catalyst at reaction conditions sufficient to achieve the desired hydroprocessing. The hydrogen is hydrogen gas, which may or may not be mixed or diluted with other gas and vapor components that do not adversely effect the reaction, products or process. If the hydrogen gas contains other such components, it is often referred to as hydrogen treat gas. If fresh hydrogen or substantially pure hydrogen is available, it is preferred that it be used at least in the second reaction stage. While in a typical embodiment, the second stage vapor effluent which passes up into the first stage will contain sufficient unreacted hydrogen to achieve the desired hydroprocessing in the first stage, at least a portion of the first stage hydrogen may be fresh hydrogen or a hydrogen-containing treat gas. In the practice of the invention, if fresh hydrogen is available, it is preferred that it be used at least for the second stage hydroprocessing. At least a portion, and more typically most (e.g., >50 wt. %) of the hydrocarbonaceous material being hydroprocessed in each stage is liquid at the reaction conditions. The hydroprocessing results in a portion of the liquid in each stage being converted to vapor. In most cases the hydrocarbonaceous material will comprise hydrocarbons.

In its broad sense, the invention comprises a staged hydroprocessing process comprising at least two cocurrent upflow hydroprocessing reaction stages and a contacting stage, for removing one or more impurities from a feed comprising a hydrocarbonaceous liquid, which comprises the steps of:

(a) reacting said feed with hydrogen in a first cocurrent, upflow hydroprocessing reaction stage in the presence of a hydroprocessing catalyst at reaction conditions effective to form a first stage effluent having a lower impurity content than said feed, said effluent comprising a first stage hydroprocessed hydrocarbonaceous liquid and a vapor which contains hydroprocessed hydrocarbonaceous feed components, wherein both said liquid and vapor effluents contain said impurities, with said impurities in equilibrium between said liquid and vapor effluents;

(b) separating said first stage liquid and vapor effluents;

(c) contacting said vapor effluent, in a contacting stage, with a hydrocarbonaceous liquid, under conditions such that impurities in said vapor transfer to said liquid, to form a contacting stage effluent comprising a hydrocarbonaceoous liquid of increased impurity content and a vapor comprising hydroprocessed hydrocarbonaceous feed components having an impurity content less than that of said first stage vapor effluent;

(d) combining said first and contacting stage liquid effluents and passing them into a second cocurrent, upflow hydroprocessing reaction stage;

(e) reacting said combined liquid effluents with hydrogen in said second hydroprocessing reaction stage, in the presence of a hydroprocessing catalyst at reaction conditions effective to form a second stage effluent having an impurity content lower than said feed, said second stage effluent comprising a hydroprocessed hydrocarbonaceous liquid and a vapor comprising hydroprocessed hydrocarbonaceous feed components and unreacted hydrogen;

(f) separating said second stage vapor and liquid effluents, and (g) passing said second stage vapor effluent into said first reaction stage.

The second stage liquid effluent, which may require stripping, comprises hydroprocessed product liquid. The contacting stage vapor effluent is typically cooled to condense a portion of the vapors to liquid, which is then separated from the remaining vapor. The liquid condensate may be combined with the second stage liquid, as additional product liquid, if desired. Also, the second stage vapor effluent may be cooled to condense out, as condensate liquid, a portion of the hydrocarbonaceous vapor components, prior to being passed up into the first stage. This condensate liquid may be recovered as additional product liquid, along with the second stage liquid effluent. The condensation may be internal or external of the reactor vessel, and conducted in a manner similar to that shown in FIGS. 2 and 3. As mentioned above, in a preferred embodiment, the hydroprocessing reaction stages and the vapor-liquid contacting stage will all be in the same reactor vessel. A specific example of this process is a hydrotreating process for removing heteroatom impurities, such as sulfur, nitrogen and oxygenate compounds, from feeds such as middle distillate fuel fractions, and heavier feeds. It being understood, however, that the invention is not limited to a hydrotreating process. This is explained in detail below. Further, and as a practical matter, the vapor effluent from each reaction stage will contain unreacted hydrogen.

DETAILED DESCRIPTION

Figure 1:
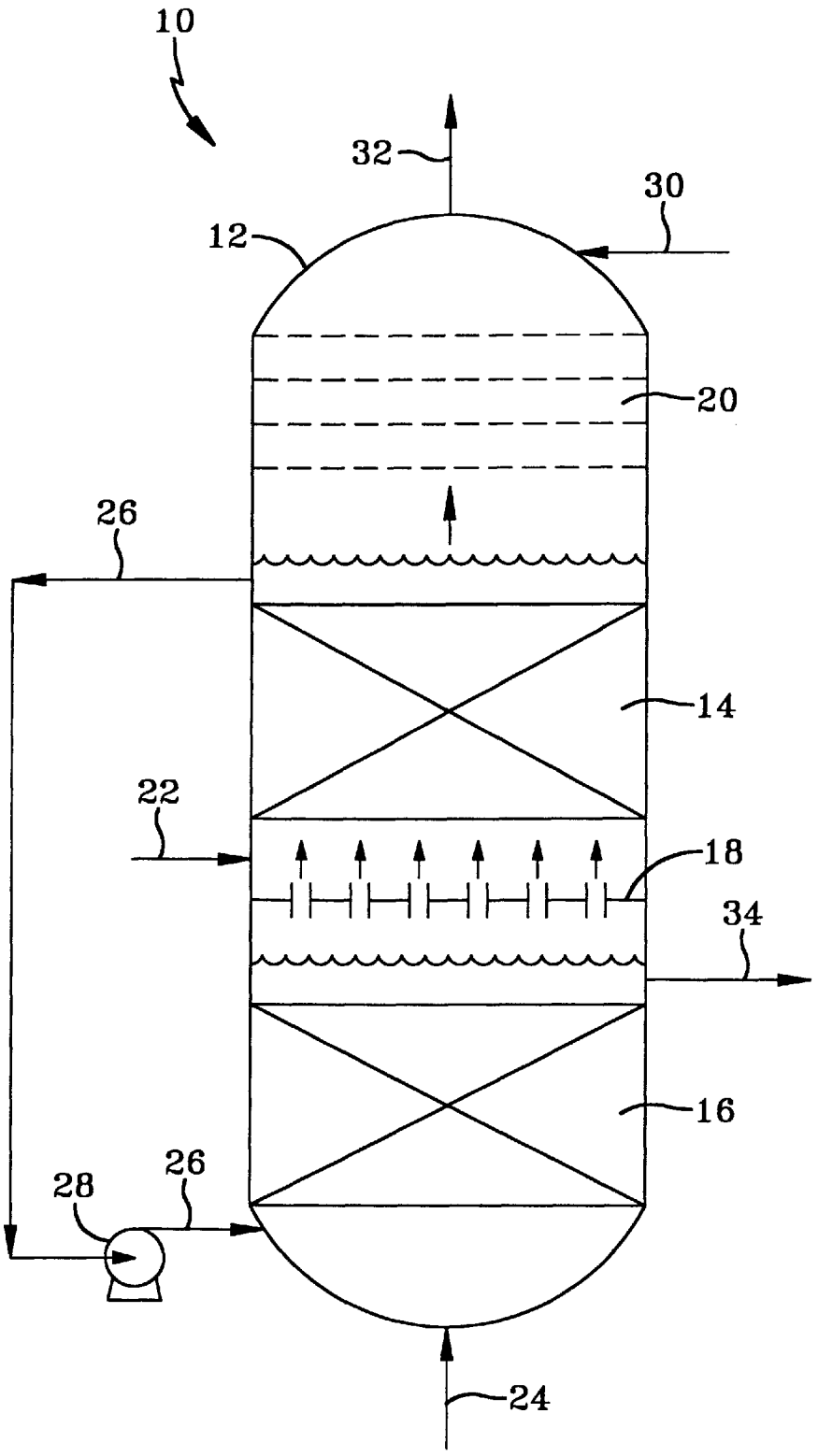
FIG. 1 schematically illustrates a flow diagram of an embodiment of the invention using two cocurrent, upflow reaction stages and a contacting stage, all in the same vessel.

By hydroprocessing is meant a process in which hydrogen reacts with a hydrocarbonaceous feed to remove one or more impurities, to change or convert the molecular structure of at least a portion of the feed, or both. An illustrative, but non-limiting example of impurities may include (i) heteroatom impurities such as sulfur, nitrogen, and oxygen, (ii) ring compounds such as aromatics, condensed aromatics and other cyclic unsaturates, (iii) metals, (iv) other unsaturates, (v) waxy materials and the like. Thus, by impurity is meant any feed component which is desired to be removed from the feed by the hydroprocessing. Illustrative, but non-limiting examples of hydroprocessing processes which can be practiced by the present invention include forming lower boiling fractions from light and heavy feeds by hydrocracking; hydrogenating aromatics and other unsaturates; hydroisomerization and/or catalytic dewaxing of waxes and waxy feeds, and demetallation of heavy streams. Ring-opening, particularly of naphthenic rings, can also be considered a hydroprocessing process. By hydrocarbonaceous feed is meant a primarily hydrocarbon material obtained or derived from crude petroleum oil, from tar sands, from coal liquefaction, shale oil and hydrocarbon synthesis. The reaction stages used in the practice of the present invention are operated at suitable temperatures and pressures for the desired reaction. For example, typical hydroprocessing temperatures will range from about 40° C. to about 450° C. at pressures from about 50 psig to about 3,000 psig, preferably 50 to 2,500 psig. The first reaction stage vapor effluent may contain impurities or undesirable feed components, such as sulfur or other heteroatom compounds, which it is desired to remove from the first stage vapor. The hydrocarbonaceous contacting liquid will have an impurity concentration no greater, and preferably lower, than the impurity concentration in the first stage liquid effluent which is in equilibrium with the first stage vapor. While this contacting liquid may be any hydrocarbonaceous liquid which does not adversely affect either the process, or the desired hydroprocessed product liquid, and into which the vapor impurities will transfer, it will more typically comprise either or both the first and second reaction stage liquid effluents. Preferably it will be cooled to a temperature lower than the first stage vapor effluent, prior to the contacting. While a lower impurity concentration in the contacting liquid will result in transfer of some impurities into it from the first stage vapor, having the contacting liquid at a temperature lower than that of the vapor, will result in transfer of more impurities, than if it was at the same temperature as the vapor.

Feeds suitable for use in such systems include those ranging from the naphtha boiling range to heavy feeds, such as gas oils and resids. Non-limiting examples of such feeds which can be used in the practice of the present invention include vacuum resid, atmospheric resid, vacuum gas oil (VGO), atmospheric gas oil (AGO), heavy atmospheric gas oil (HAGO), steam cracked gas oil (SCGO), deasphalted oil (DAO), light cat cycle oil (LCCO), natural and synthetic feeds derived from tar sands, shale oil, coal liquefaction, hydrocarbons synthesized from a mixture of $H_2$ and CO via a Fischer-Tropsch type of hydrocarbon synthesis, and mixtures thereof.

For purposes of hydroprocessing and in the context of the invention, the terms "hydrogen" and "hydrogen-containing treat gas" are synonymous, and may be either pure hydrogen or a hydrogen-containing treat gas which is a treat gas stream containing hydrogen in an amount at least sufficient for the intended reaction, plus other gas or gasses (e.g., nitrogen and light hydrocarbons such as methane) which will not adversely interfere with or affect either the reactions or the products. Impurities, such as $H_2S$ and $NH_3$ are undesirable and, if present in significant amounts, will normally be removed from the treat gas, before it is fed into the reactor. The treat gas stream introduced into a reaction stage will preferably contain at least about 50 vol. %, more preferably at least about 75 vol. % hydrogen. In operations in which unreacted hydrogen in the vapor effluent of any particular stage is used for hydroprocessing in any stage, there must be sufficient hydrogen present in the fresh treat gas introduced into that stage, for the vapor effluent of that stage to contain sufficient hydrogen for the subsequent stage or stages. It is preferred in the practice of the invention that all or a portion of the hydrogen required for the first stage hydroprocessing be contained in the second stage vapor effluent fed up into the first stage.

The invention can be further understood with reference to FIG. 1, which is a schematic flow diagram of a hydroprocessing unit useful in the practice of the invention, comprising two consecutive cocurrent upflow reaction stages and a vapor-liquid contacting stage, in a single reactor vessel. In this particular embodiment the hydroprocessing process is a hydrotreating process and the reaction stages hydrotreating stages. For the sake of simplicity, not all process reaction vessel internals, valves, pumps, heat transfer devices etc. are shown. Thus, a hydrotreating unit 10 comprises a hollow, cylindrical metal reactor vessel 12, containing respective fixed catalyst beds 14 and 16 separated by a tray 18 within, for hydrotreating a distillate or diesel fuel feed. Catalyst beds 14 and 16 respectively comprise first and second hydrotreating stages. A vapor-liquid contacting stage 20, comprising vapor-liquid contacting means indicated by the dashed lines, is shown disposed above the first hydrotreating stage 14. The heteroatom-containing hydrocarbon feed to be hydrotreated, enters the first stage reaction vessel 12 via line 22. In this particular illustration of the invention, the feed is a petroleum derived distillate or diesel fuel fraction containing heteroatom compounds of sulfur, nitrogen and perhaps oxygen. Hydrogen gas, or a hydrogen-containing treat gas, is introduced into the bottom of the reactor under the second stage catalyst bed 16, via gas line 24. As mentioned above, it is preferred that this gas comprise at least 50% hydrogen gas and, for the second stage it is preferred that it comprise at least 75% hydrogen gas. The amount of hydrogen introduced into the reactor via line 24, must be sufficient for both hydrotreating reaction stages in the embodiment (shown) in which it also provides all of the hydrogen for the first reaction stage. The heteroatom-containing hydrocarbon feed to be hydrotreated, enters the first stage reaction vessel 12 via line 22. In this particular illustration of the invention, the feed is a petroleum derived distillate or diesel fuel fraction containing heteroatom compounds of sulfur, nitrogen and perhaps oxygen. Hydrogen-rich vapor effluent from the second reaction stage passes up through the gas permeable tray 18 separating the first and second reaction stages. Such trays are known in the art and typically comprise a metal disk provided with a plurality of pipes extending therethrough, a bubble cap tray and the like. The pressure in the second reaction stage is greater than that in the first reaction stage, to permit the hydrogen-rich vapor to pass up through the tray 18, the first reaction and contacting stages, and out of the reactor, while not permitting the liquid feed to pass down into the second stage. The feed and hydrogen-rich second stage vapor pass cocurrently up into and through catalyst bed 14, which contains a sulfur tolerant catalyst, in which the feed reacts with the hydrogen in the presence of the catalyst, to remove feed impurities. In the case of hydrotreating, these impurities comprise oxygenates, sulfur and nitrogen compounds, olefins and aromatics. The hydrogen reacts with the impurities to convert them to $H_2S$, $NH_3$, and water vapor, which are removed as part of the vapor effluent, and it also saturates olefins and aromatics. This forms a first stage effluent comprising a mixture of partially hydrotreated hydrocarbon liquid and vapor, with the vapor containing vaporized feed components, unreacted hydrogen, $H_2S$ and $NH_3$. As those skilled in the art know, in hydrotreating and other hydroprocessing processes, the amount of hydrogen passed into a hydroprocessing reaction stage is in excess of that amount theoretically required to achieve the desired degree of conversion. This is done to maintain a sufficient hydrogen partial pressure throughout the reaction zone. Therefore, the vapor effluent from each hydroprocessing reaction zone will contain the unreacted hydrogen. Most (e.g., ≧50%) of the feed hydrotreating is accomplished in the first stage. In two stage hydrotreating processes, it is not unusual for 60%, 75% and even ≧90% of the heteroatom (S, N and O) compounds in the feed to be removed from the liquid in the first stage, by converting them to $H_2S$, $NH_3$, and $H_2O$. Therefore, the second stage catalyst can be a more kinetically active, but less sulfur tolerant catalyst than the first stage catalyst for heteroatom removal, and in addition can also achieve greater aromatics saturation. In this embodiment the first stage catalyst may comprise cobalt and molybdenum catalytic components supported on alumina, and the second stage catalyst may comprise nickel-molybdenum or nickel-tungsten catalytic metal components on an alumina support. Since the first stage vapor and liquid effluents are in equilibrium with respect to the feed impurities and the liquid effluent is only partially hydrotreated, some feed impurities are also present in the first stage vapor effluent. The first stage vapor effluent separates from the partially hydrotreated liquid effluent and passes up into contacting stage 20, as indicated by the arrow. Hydrocarbon contacting liquid is introduced into the vessel above the top of the contacting means of the contacting stage via line 30. As the first reaction stage vapor effluent flows up through the contacting means, it is contacted by the downflowing liquid under conditions effective for transferring at least a portion of the deed impurities in the vapor into the liquid. The contacting means comprises any known liquid-vapor contacting means, such as rashig rings, berl saddles, wire mesh, ribbon, open honeycomb, gas-liquid contacting trays, such as bubble cap trays and other devices, etc. In the embodiment shown in the Figure, the dashed lines shown as the contacting means 20, represent gas-liquid contacting trays. Conditions effective for impurity transfer from the vapor to the contacting liquid include a combination of temperatures and impurity concentrations conducive to transferring the desired amount of impurities from the vapor into the liquid. If the downflowing liquid has an impurity concentration greater than what it would be if the liquid and vapor were in equilibrium with respect to the impurity concentrations, then the contacting liquid is at a temperature sufficiently lower than that of the vapor to achieve the desired transfer. Preferably the impurity concentration in the contacting liquid is less than the equilibrium concentration, and more preferably the liquid is at a lower temperature than the vapor and with an impurity concentration less than the equilibrium concentration. The liquid temperature is determined by the vapor temperature and the relative concentrations, solubilities and condensation temperatures of the heteroatom compounds in each phase. The combination of temperatures and concentrations is such as to transfer the desired amount of these compounds to the liquid by absorption, condensation and equilibrium concentration differentials, to achieve the desired vapor purity. While any suitable hydrocarbon liquid can be used, it is preferred that at least a portion of the contacting liquid comprise at least one of the first and second reaction stage liquid effluents. More preferably it will comprise the second stage liquid effluent, which has an impurity concentration below that of the first stage liquid effluent in equilibrium with the first stage vapor effluent. The impurity-reduced vapor is removed from the top of the reactor via line 32. The impurity-reduced vapor is preferably cooled to condense the heavier (e.g., $C_{4+}$–$C_{5+}$) hydrotreated vapor hydrocarbon components to liquid which is separated from the remaining vapor, with the liquid then combined with the hydrotreated second stage liquid effluent as additional product liquid, if desired. This condensed and recovered hydrotreated liquid may require stripping to remove any remaining $H_2S$ and $NH_3$. The vapor remaining after cooling and condensation will comprise mostly methane, ethane and unreacted hydrogen, along with most of the $H_2S$ and $NH_3$ formed by the hydrotreating. The impurity-increased contacting liquid passes down onto the top of the first reaction stage where it combines and mixes with the first reaction stage liquid effluent. The combined liquids form a layer above the first stage as indicated in the Figure, are withdrawn via line 26 and passed down into the bottom of the vessel under the second stage, by means of liquid pump 28 and recycle line 26. The combined liquid and fresh hydrogen or hydrogen-containing treat gas pass cocurrently up through the second hydrotreating reaction stage 16. During the second stage hydrotreating, most of the heteroatom compounds in the combined liquid are removed, with the $H_2S$ and $NH_3$ formed by the hydrotreating passing into the vapor. The second stage produces a hydrotreated liquid and vapor effluent. The vapor separates from the liquid above the stage and passes up through tray 18 and into the first stage reaction zone. The second stage vapor effluent comprises mostly unreacted hydrogen, along with methane, ethane and minor amounts of $H_2S$ and $NH_3$. If the second stage vapor effluent contains significant levels of heavier hydrocarbons (e.g., $C_{4+}$), they may be condensed using either internal or external cooling means, such as those shown on FIGS. 2 and 3 and discussed in detail below. The unreacted hydrogen comprises the hydrogen for the first stage hydrotreating. The hydrotreated second stage liquid comprises the product liquid and forms a layer above the first stage as indicated in the figure. This product liquid is withdrawn via line 34 and sent to stripping to remove any remaining $H_2S$ and $NH_3$ that might be present.

Figure 2:
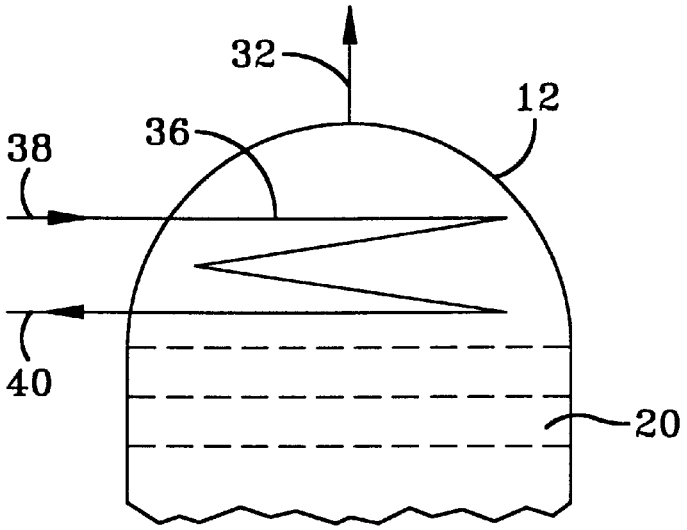
FIG. 2 is a schematic illustration of the upper portion of the reactor, in which is disposed vapor cooling means.
Figure 3:
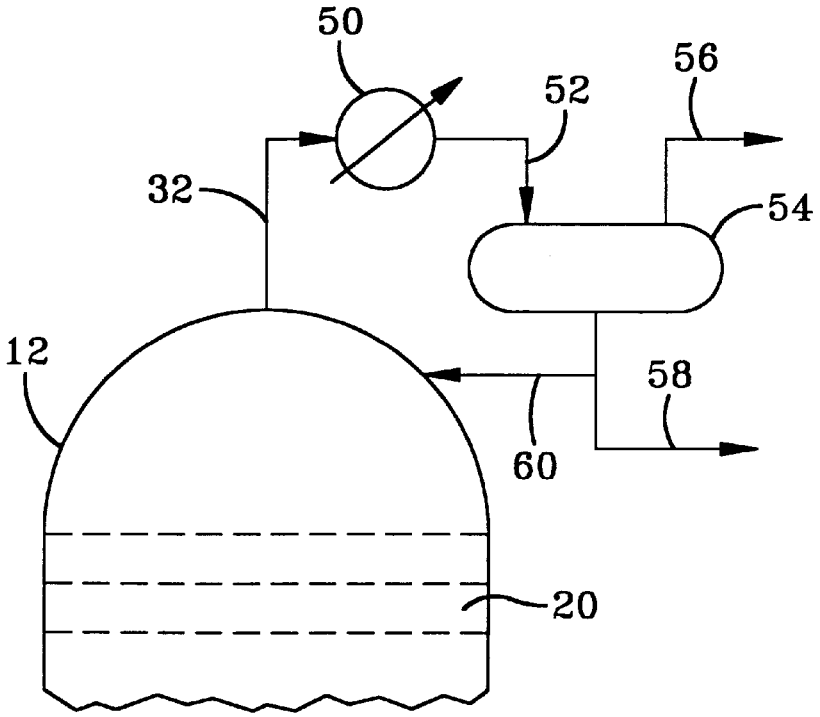
FIG. 3 is a schematic illustration of the upper portion of the reactor, and external means for vapor cooling and recycle of condensed liquid back into the reactor.

FIG. 2 is a partial schematic of the upper portion of the upper portion of the reactor vessel in FIG. 1, with the addition of internal cooling means 36 disposed inside the reactor, above the contacting stage. Cooling means 36 is schematically illustrated as cooling coils. A cooling liquid, such as water, is introduced into the coils via line 38 and exits via line 40. The cooling means condenses a portion of the $C_{4+}$–$C_{5+}$ hydrocarbons in the vapor as liquid. This liquid then flows down into the contacting stage as part of the hydrocarbon contacting liquid, thereby reducing the amount of contacting liquid required from other sources. FIG. 3 illustrates yet another embodiment in which a portion of the contacting stage vapor effluent is cooled to condense the heavier hydrocarbons out of the vapor as liquid. In this embodiment the cooling is accomplished external of the reactor. Thus, contacting stage vapor effluent leaving the top of the reactor via line 32 is passed through heat exchange means 50, in which it is cooled to condense $C_{4+-C5+}$ hydrocarbons in the vapor to liquid, as hydrocarbon condensate. The resulting vapor-liquid mixture passes, via line 52, into a vapor-liquid separator 54, which may be a simple flash or drum separator. The remaining vapor separates from the hydrocarbon liquid condensate and is removed from the separator via line 56. A portion of the liquid hydrocarbon condensate is recycled back into the reactor via line 60 as part of the contacting liquid, while the rest of the condensate is removed via line 58 as product liquid.

In all of the above embodiments, after cooling, the remaining vapor may be treated by known means, such as scrubbing with an aqueous amine solution, to remove the $H_2S$ and $NH_3$. A portion of the light hydrocarbons remaining are purged, and the remaining vapor, which contains unreacted hydrogen, passed back into the reactor as part of the hydrogen required for the hydrotreating.

Those skilled in the art will appreciate that the invention can be extended to more than two reaction and one contacting stages, and also that the contacting stage may be in a separate vessel, instead of the reaction vessel. Thus, one may also employ three or more reaction stages in which the partially processed liquid effluent from the first stage is the second stage feed, the second stage liquid effluent is the third stage feed, and so on, with attendant vapor stage contacting in one or more liquid-vapor contacting stages. By reaction stage is meant at least one catalytic reaction zone in which the liquid, or mixture of liquid and vapor reacts with hydrogen in the presence of a suitable hydroprocessing catalyst to produce an at least partially hydroprocessed effluent. The catalyst in an upflow reaction zone of the invention is typically in the form of a fixed bed. More than one catalyst can also be employed in a particular zone as a mixture or in the form of layers (for a fixed bed).

The term "hydrotreating" as used herein refers to processes wherein a hydrogen-containing treat gas is used in the presence of a suitable catalyst which is primarily active for the removal of heteroatoms, such as sulfur, and nitrogen, non-aromatics saturation and, optionally, saturation of aromatics. Suitable hydrotreating catalysts for use in a hydrotreating embodiment of the invention include any conventional hydrotreating catalyst. Examples include catalysts comprising of at least one Group VIII metal catalytic component, preferably Fe, Co and Ni, more preferably Co and/or Ni, and most preferably Co; and at least one Group VI metal catalytic component, preferably Mo and W, more preferably Mo, on a high surface area support material, such as alumina. Other suitable hydrotreating catalysts include zeolitic catalysts, as well as noble metal catalysts where the noble metal is selected from Pd and Pt. The Groups referred to herein are those found in the Periodic Table of the Elements, copyrighted in 1968 by the Sargent-Welch Scientific Company. As mentioned above, it is within the scope of the present invention that more than one type of hydrotreating catalyst may be used in the same reaction stage or zone. Typical hydrotreating temperatures range from about 100° C. to about 400° C. with pressures from about 50 psig to about 3,000 psig, preferably from about 50 psig to about 2,500 psig. If one of the reaction stages is a hydrocracking stage, the catalyst can be any suitable conventional hydrocracking catalyst run at typical hydrocracking conditions. Typical hydrocracking catalysts are described, for example, in U.S. Pat. No. 4,921,595, the disclosure of which is incorporated herein by reference. Such catalysts are typically comprised of a Group VIII metal hydrogenating component on a zeolite cracking base. Hydrocracking conditions include temperatures from about 200° to 425° C.; a pressure of about 200 psig to about 3,000 psig; and liquid hourly space velocity from about 0.5 to 10 V/V/Hr, preferably from about 1 to 5 V/V/Hr. Non-limiting examples of aromatic hydrogenation catalysts include nickel, cobalt-molybdenum, nickel-molybdenum, and nickel-tungsten. Noble metal (e.g., platinum and/or palladium) containing catalysts can also be used. The aromatic saturation zone is preferably operated at a temperature from about 40° C. to about 400° C., more preferably from about 260° C. to about 350° C., at a pressure from about 100 psig to about 3,000 psig, preferably from about 200 psig to about 1,200 psig, and at a liquid hourly space velocity (LHSV) of from about 0.3 V/V/Hr. to about 2 V/V/Hr.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A staged hydroprocessing process comprising at least two cocurrent upflow hydroprocessing reaction stages and a contacting stage in a single reactor, for removing one or more impurities from a hydrocarbonaceous feed, at least a portion of which is liquid, which comprises the steps of:

(a) reacting said feed with hydrogen in a first cocurrent, upflow hydroprocessing reaction stage in the presence of a hydroprocessing catalyst at reaction conditions effective to form a first stage effluent having a lower impurity content than said feed, said effluent comprising a first stage hydroprocessed hydrocarbonaceous liquid and a vapor which contains hydroprocessed hydrocarbonaceous feed components, wherein both said liquid and vapor effluents contain said impurities, with said impurities in equilibrium between said liquid and vapor effluents;

(b) separating said first stage liquid and vapor effluents;

(c) contacting said vapor effluent, in a contacting stage, with a hydrocarbonaceous liquid, under conditions such that impurities in said vapor transfer to said liquid, to form a contacting stage effluent comprising a hydrocarbonaceous liquid of increased impurity content and a vapor comprising hydroprocessed hydrocarbonaceous feed components having an impurity content less than that of said first stage vapor effluent;

(d) combining said first stage hydroprocessed hydrocarbonaceous liquid and contacting stage liquid effluents and passing them into a second cocurrent, upflow hydroprocessing reaction stage;

(e) reacting said combined liquid effluents with hydrogen in said second hydroprocessing reaction stage, in the presence of a hydroprocessing catalyst at reaction conditions effective to form a second stage effluent having an impurity content lower than said feed, said second stage effluent comprising a hydroprocessed hydrocarbonaceous liquid and a vapor comprising hydroprocessed hydrocarbonaceous feed components and unreacted hydrogen;

(f) separating said second stage vapor and liquid effluents, and (g) passing said second stage vapor effluent into said first reaction stage.

2. A process according to claim 1 wherein said first and second reaction stage catalysts are the same or different.

3. A process according to claim 2 wherein said second stage liquid effluent comprises product liquid.

4. A process according to claim 3 wherein said contacting conditions comprise at least one of (i) said contacting liquid is at temperature being below that of said vapor prior to contacting, and (ii) said contacting liquid impurity content is below what it would be, if said liquid was in equilibrium concentration with said vapor, with respect to said impurity concentration.

5. A process according to claim 4 wherein said contacting stage vapor effluent is cooled to condense a portion of said hydrocarbonaceous components to liquid.

6. A process according to claim 5 wherein said contacting liquid is cooled to a temperature below that of said vapor during contacting.

7. A process according to claim 4 wherein said contacting stage includes internal reflux.

8. A process according to claim 6 wherein a portion of said contacting liquid comprises said contacting stage vapor effluent condensate.

9. A process according to claim 7 wherein, before said second reaction stage vapor effluent is passed to said first reaction stage, at least a portion of said vapor is cooled to condense out as liquid, at least a portion of said hydroprocessed hydrocarbonaceous feed components present in said vapor.

10. A staged hydrotreating process comprising at least two cocurrent upflow hydrotreating reaction stages and a contacting stage in a single reactor, for removing one or more impurities comprising heteroatom compounds and unsaturates from a feed comprising a hydrocarbon liquid, which comprises the steps of:

(a) reacting said feed with hydrogen in a first cocurrent, upflow hydrotreating reaction stage in the presence of a hydrotreating catalyst at reaction conditions effective to form a first stage effluent having a lower impurity content than said feed, said effluent comprising a first stage hydrotreated hydrocarbon liquid and a vapor which contains hydrotreated hydrocarbon feed components, wherein both said liquid and vapor effluents contain said impurities, with said impurities in equilibrium between said liquid and vapor effluents;

(b) separating said first stage liquid and vapor effluents;

(c) contacting said vapor effluent, in a contacting stage, with a hydrocarbon liquid, under conditions such that impurities in said vapor transfer to said liquid, to form a contacting stage effluent comprising a hydrocarbon liquid of increased impurity content and a vapor comprising hydrotreated hydrocarbon feed components having an impurity content less than that of said first stage vapor effluent;

(d) combining said first stage hydroprocessed hydrocarbonaceous liquid and contacting stage liquid effluents and passing them into a second cocurrent, upflow hydrotreating reaction stage;

(e) reacting said combined liquid effluents with hydrogen in said second hydrotreating reaction stage, in the presence of a hydrotreating catalyst at reaction conditions effective to form a second stage effluent having an impurity content lower than said feed, said second stage effluent comprising a hydrotreated hydrocarbonaceous liquid and a vapor comprising hydrotreated hydrocarbon feed components and unreacted hydrogen;

(f) separating said second stage vapor and liquid effluents, and (g) passing said second stage vapor effluent into said first reaction stage.

11. A process according to claim 10 wherein said first and second reaction stage catalysts are the same or different.

12. A process according to claim 11 wherein said second stage liquid effluent comprises product liquid.

13. A process according to claim 12 wherein said contacting conditions comprise at least one of (i) said contacting temperature being below that of said vapor, and (ii) said contacting liquid impurity content being below what it would be, if said liquid was in equilibrium concentration with said vapor, with respect to said impurity concentration.

14. A process according to claim 13 wherein said contacting stage vapor effluent is cooled to condense a portion of said hydrocarbon components to liquid.

15. A process according to claim 13 wherein said contacting liquid is cooled to a temperature below that of said vapor during contacting.

16. A process according to claim 13 wherein said contacting stage includes internal reflux.

17. A process according to claim 15 wherein a portion of said contacting liquid comprises said contacting stage vapor effluent condensate.

18. A process according to claim 16 wherein a portion of said contacting liquid comprises said contacting stage vapor effluent condensate.

19. A staged hydroprocessing process comprising at least two cocurrent upflow hydroprocessing reaction stages in a single reactor, with a vapor-liquid contacting stage in a separate vessel, for removing one or more impurities from a hydrocarbonaceous feed, at least a portion of which is liquid, which comprises the steps of:

(a) reacting said feed with hydrogen in a first cocurrent, upflow hydroprocessing reaction stage in the presence of a hydroprocessing catalyst at reaction conditions effective to form a first stage effluent having a lower impurity content than said feed, said effluent comprising a first stage hydroprocessed hydrocarbonaceous liquid and a vapor which contains hydroprocessed hydrocarbonaceous feed components, wherein both said liquid and vapor effluents contain said impurities, with said impurities in equilibrium between said liquid and vapor effluents;

(b) separating said first stage liquid and vapor effluents;

(c) contacting said vapor effluent, in said contacting stage, with a hydrocarbonaceous liquid, under conditions such that impurities in said vapor transfer to said liquid, to form a contacting stage effluent comprising a hydrocarbonaceoous liquid of increased impurity content and a vapor comprising hydroprocessed hydrocarbonaceous feed components having an impurity content less than that of said first stage vapor effluent;

(d) combining said first stage hydroprocessed hydrocarbonaceous liquid and contacting stage liquid effluents and passing them into a second cocurrent, upflow hydroprocessing reaction stage;

(e) reacting said combined liquid effluents with hydrogen in said second hydroprocessing reaction stage, in the presence of a hydroprocessing catalyst at reaction conditions effective to form a second stage effluent having an impurity content lower than said feed, said second stage effluent comprising a hydroprocessed hydrocarbonaceous liquid and a vapor comprising hydroprocessed hydrocarbonaceous feed components and unreacted hydrogen;

(f) separating said second stage vapor and liquid effluents, and (g) passing said second stage vapor effluent into said first reaction stage.

20. A process according to claim 14 wherein said first and second reaction stage catalysts are the same or different and wherein said second stage liquid effluent comprises product liquid.

21. A process according to claim 20 wherein said contacting conditions comprise at least one of (i) said contacting liquid is at temperature being below that of said vapor prior to contacting, and (ii) said contacting liquid impurity content is below what it would be, if said liquid was in equilibrium concentration with said vapor, with respect to said impurity concentration.

22. A process according to claim 21 wherein said contacting stage vapor effluent is cooled to condense a portion of said hydrocarbonaceous components to liquid.

23. A process according to claim 21 wherein said contacting liquid is cooled to a temperature below that of said vapor during contacting.

24. A process according to claim 23 wherein said contacting stage includes internal reflux.

25. A process according to claim 22 wherein a portion of said contacting liquid comprises said contacting stage vapor effluent condensate.

26. A process according to claim 23 wherein a portion of said contacting liquid comprises said contacting stage vapor effluent condensate.

* * * * *